US007497542B2

(12) United States Patent
Niioka

(10) Patent No.: US 7,497,542 B2
(45) Date of Patent: Mar. 3, 2009

(54) SENSOR FOR DETECTING EDGE OF PRINTING MEDIUM, AND PRINTER INCORPORATING THE SAME

(75) Inventor: Koji Niioka, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 266 days.

(21) Appl. No.: 11/544,891

(22) Filed: Oct. 5, 2006

(65) Prior Publication Data

US 2007/0097165 A1 May 3, 2007

(30) Foreign Application Priority Data

Oct. 5, 2005 (JP) ..... P2005-292138
May 11, 2006 (JP) ..... P2006-133011

(51) Int. Cl.
*B41J 29/393* (2006.01)

(52) U.S. Cl. ..... 347/19; 347/81

(58) Field of Classification Search ..... 347/19, 347/81, 37, 85, 86
See application file for complete search history.

(56) References Cited

U.S. PATENT DOCUMENTS 6,929,344 B2 * 8/2005 Hwang ..... 347/19
2007/0109338 A1 * 5/2007 Niioka ..... 347/16

FOREIGN PATENT DOCUMENTS

JP 2001-247225 9/2001

* cited by examiner

*Primary Examiner*—Lamson D Nguyen
(74) *Attorney, Agent, or Firm*—John J. Penny, Jr.; Edwards Angell Palmer & Dodge LLP

(57) ABSTRACT

A recording head has a plurality of nozzles adapted to eject ink droplets toward a printing medium which is transported in a first direction. A head supporting member supports the recording head. A light emitter is operable to emit light. A light receiver is adapted to receive light reflected from the printing medium. The nozzles are arranged in the first direction to form a nozzle array. The light emitter and the light receiver are disposed between a first one of the nozzles and an upstream end of the head supporting member relative to the first direction. The first one of the nozzles is located in an upstream end of the nozzle array relative to the first direction. The light emitter and the light receiver are provided on the head supporting member and arranged in a second direction perpendicular to the first direction.

7 Claims, 9 Drawing Sheets

1: printer
2: host computer
34: recording head
41: external interface
42: power button
51: sheet feeding sensor
52: sheet edge sensor
53: linear encoder
54: rotary encoder
61: head controller
62: carriage motor driver
63: carriage motor
64: sheet feeding motor driver
65: sheet feeding motor
75: timer
81: firm program 61: head controller
62: carriage motor driver
63: carriage motor
64: sheet feeding motor driver
65: sheet feeding motor
91: controller
92: DC unit 61: head controller
62: carriage motor driver
63: carriage motor
64: sheet feeding motor driver
65: sheet feeding motor
92: DC unit
131: controller 61: head controller
62: carriage motor driver
63: carriage motor
64: sheet feeding motor driver
65: sheet feeding motor
92: DC unit
141: controller

SENSOR FOR DETECTING EDGE OF PRINTING MEDIUM, AND PRINTER INCORPORATING THE SAME

BACKGROUND

1. Technical Field

The present invention relates to a sensor for detecting an edge of a printing medium and to a printer incorporating the same.

2. Related Art

Japanese Patent Publication No. 2001-247225A (JP-A-2001-247225) discloses an ink jet printer. The ink jet printer transports a printing medium such as paper on a sheet feeding tray to a printing region facing a printing head. Accordingly, printing by ink is performed on the paper by ejecting ink from the printing head.

In the printer disclosed in JP-A-2001-247225, for transport control of a printing medium, such as paper, it is necessary to recognize a position of the printing medium to be transported on a sheet transporting path.

For example, the printer needs to recognize presence/absence of the paper in the printing region so as to prevent ink from being ejected from the printing head in a state where paper does not exist in the printing region.

Besides, for example, the printer reduces the amount of sheet feeding pitch when the trailing end of the paper is printed or performs various controls for suppress ink from being ejected outside the paper. For these controls, it is necessary to recognize the position of the edge of the paper within the printing region.

In particular, when the sheet feeding speed increases or the sheet feeding pitch increases in order to increase the number of print pages per unit time, the edge of the paper to be transported to the printing region facing the recording head needs to be accurately and rapidly detected. When the accurate position of the edge of the paper to be transported is detected more rapidly, it is possible to increase the number of print pages per unit time.

SUMMARY

It is therefore an advantage of some aspects of the invention to obtain a sensor that can accurately and rapidly detect an edge of a printing medium to be transported to a printing region facing a recording head, and to obtain a printer incorporating such a sensor.

According to one aspect of the invention, there is provided a printer, comprising:

a recording head, having a plurality of nozzles adapted to eject ink droplets toward a printing medium which is transported in a first direction;

a head supporting member, supporting the recording head;

a light emitter, operable to emit light; and a light receiver, adapted to receive light reflected from the printing medium, wherein:

the nozzles are arranged in the first direction to form a nozzle array;

the light emitter and the light receiver are disposed between a first one of the nozzles and an upstream end of the head supporting member relative to the first direction;

the first one of the nozzles is located in an upstream end of the nozzle array relative to the first direction; and the light emitter and the light receiver are provided on the head supporting member and arranged in a second direction perpendicular to the first direction.

The head supporting member may be a carriage operable to carry the recording head, the light emitter and the light receiver in the second direction.

The printer may further comprise a sensor body, formed with recesses respectively holding the light emitter and the light receiver.

The sensor body may have a first face facing the upstream side, and the carriage has a second face facing the upstream side. The sensor body may be attached on the carriage such that the first face is made flush with the second face.

The printer may further comprise a connector section, formed in the sensor body and adapted to be connected with a mating connector which is electrically connected to a control section of the printer.

The printer may further comprise a retainer, provided on the carriage and retaining the sensor body.

A projection may be extended from the sensor body in the second direction. The retainer may comprise a pair of projections arranged in the first direction and clamping the projection therebetween.

According to one aspect of the invention, there is also provided a printing method performed in a printer which comprises:

a recording head, having a plurality of nozzles adapted to eject ink droplets toward a printing medium which is transported in a first direction;

a head supporting member, supporting the recording head;

a light emitter, disposed on the head supporting member and operable to emit light; and a light receiver, disposed on the head supporting member and adapted to receive light reflected from the printing medium, the method comprising:

emitting light from the light emitter;

detecting that the presence of the printing medium based on change in a light receiving condition of the light receiver;

counting a prescribed time period from a timing that the light receiving condition is changed; and reducing at least one of a speed for transporting the printing medium and an area to which the ink is ejected from the recording head when the prescribed time period is counted.

The detecting of the presence of the printing medium may be performed with the light emitter and the light receiver which are disposed between a first one of the nozzles and an upstream end of the head supporting member relative to the direction that the nozzle, and arranged in a second direction perpendicular to the first direction. The nozzles may be arranged in the first direction to form a nozzle array, and the first one of the nozzles may be located in an upstream end of the nozzle array relative to the first direction.

DESCRIPTION OF THE EXEMPLARY EMBODIMENT

Embodiments of the invention will be described below in detail with reference to the accompanying drawings. Moreover, the description will be given by way of paper, such as a normal paper, as a printing medium.

Figure 1:
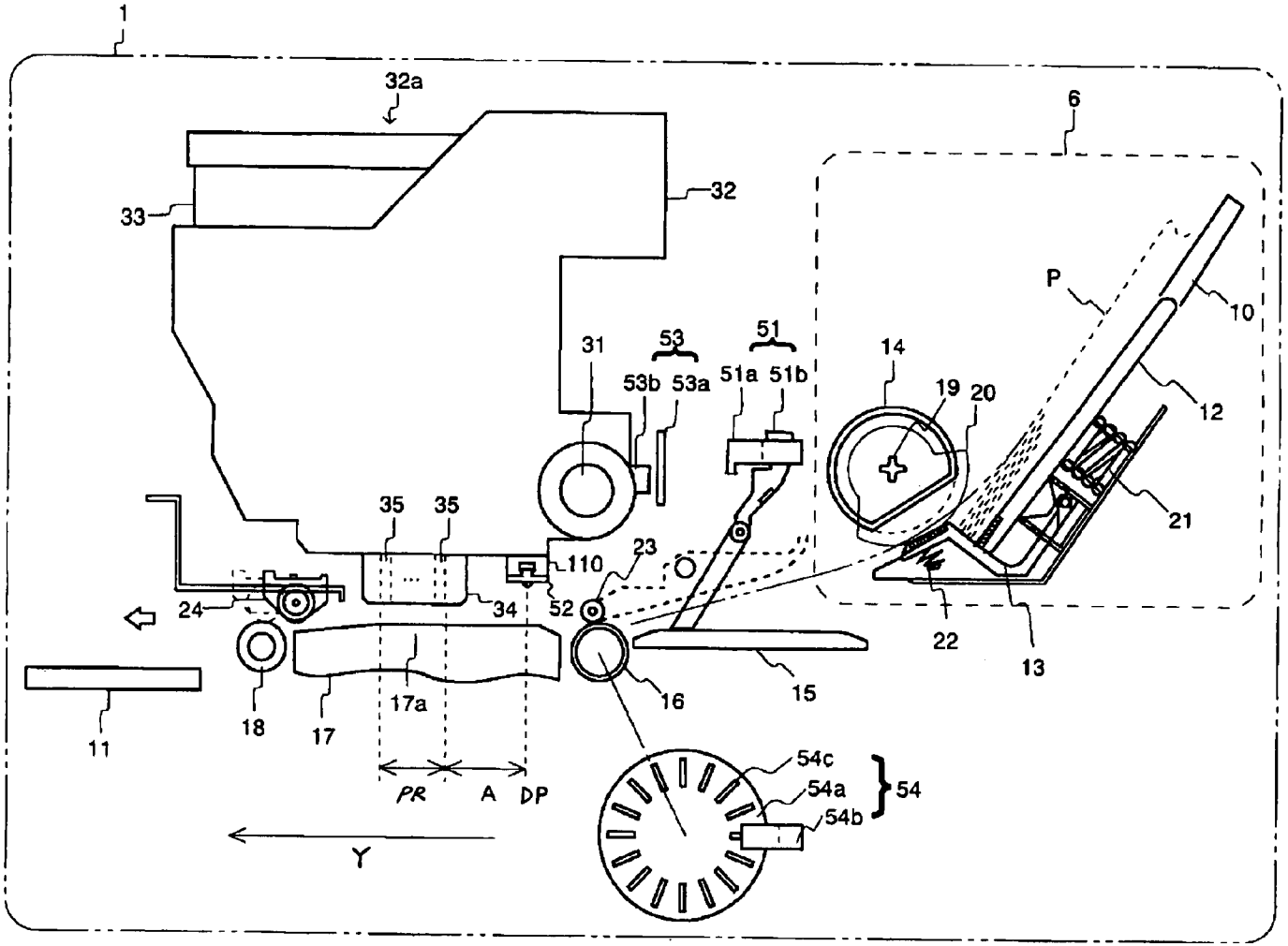
FIG. 1 is a schematic section view showing an internal configuration of a printer according to a first embodiment of the invention.

FIG. 1 shows a printer 1 according to a first embodiment of the invention. When an external interface 41 shown in FIG. 2 receives print data, the printer 1 executes a sheet feeding control and an ink ejection control from a recording head 34 according to the print data, and prints images based on the print data on the printing medium, such as a normal paper, transported by the sheet feeding control.

In order to perform such printing, the printer 1 has a sheet transporting mechanism that transports paper P placed on a sheet feeding tray 10 to a sheet ejecting tray 11, and an ink ejection mechanism that ejects ink at a printing position set on a sheet transporting path. Hereinafter, a sheet transporting path of the paper P is designated as a path extending from the sheet feeding tray 10 to the sheet ejecting tray 11. Further, a side close to the sheet feeding tray 10 is referred to as an upstream side in a sheet transporting direction Y, and a side close to the sheet ejecting tray 11 is referred to as a downstream side in the sheet transporting direction Y.

The sheet transporting mechanism that transports the paper P from the sheet feeding tray 10 to the sheet ejecting tray 11 comprises a load roller 14, a sheet guide 15, a sheet feeding roller 16, a platen 17, a sheet ejecting roller 18, and the like. The sheet feeding tray 10 and the load roller 14 are integrated as an automatic sheet feeding unit (ASF) 6.

The load roller 14 is provided to rotate with a rotary shaft 19 extending in a direction substantially perpendicular to the paper of FIG. 1. As shown in FIG. 1, the load roller 14 has a substantially semicircular section. The load roller 14 is provided at an end on the downstream side of the sheet feeding tray 10. Further, the sheet feeding tray 10 is provided in an inclined state where one end close to the load roller 14 is made lower. Moreover, at a position facing the load roller 14, a hopper 12, a separator 13, and the like may be provided.

The sheet guide 15, the sheet feeding roller 16, the platen 17, and the sheet ejecting roller 18 of the sheet transporting mechanism are provided in line between the automatic sheet feeding unit 6 and the sheet ejecting tray 11.

The sheet guide 15 is a plate member having a flat upper face.

The sheet feeding roller 16 is a substantially columnar roller. Above the sheet feeding roller 16, a follower roller 23 having a substantially columnar shape is provided. The sheet feeding roller 16 and the follower roller 23 are provided to rotate with a direction substantially perpendicular to the paper of FIG. 1 as a rotary axis.

The platen 17 has a plurality of guide ribs 17*a* at its upper face. The platen 17 is provided such that the extending direction of the guide ribs 17*a* follows the sheet transporting direction Y. Further, the platen 17 is formed of a resin material having a color different from the paper P, for example, black or the like. Moreover, in the platen 17, an ink receiving member, such as a sponge or the like, may be provided. The ink receiving member is provided lower than the guide ribs 17*a*.

The sheet ejecting roller 18 is a substantially columnar roller. Above the sheet ejecting roller 18, a follower roller 24 having a substantially columnar shape is provided. The sheet ejecting roller 18 and the follower roller 24 are provided to rotate with a direction substantially perpendicular to the paper of FIG. 1 as a rotary axis.

Above the sheet transporting mechanism having the above-described configuration, the ink ejection mechanism is provided. The ink ejection mechanism comprises a carriage shaft 31, a carriage 32, an ink tank 33, a recording head 34, and the like.

The carriage shaft 31 is a columnar shaft member. The carriage shaft 31 is provided to extend in a direction substantially perpendicular to the paper of FIG. 1 above the sheet feeding roller 16.

The carriage 32 is held by the carriage shaft 31, and is located above the platen 17. The carriage 32 can move along an axial direction of the carriage shaft 31 (direction X shown in FIG. 5).

The ink tank 33 is a container that contains liquid ink, and is detachably provided in a recess formed in an upper portion of the carriage 32. The printer 1 generally uses ink of 4 to 8 colors. One ink tank 33 may contain ink of one color or may contain ink of a plurality of colors.

The recording head 34 has a plurality of nozzles 35. Inside each of the nozzles 35, a piezoelectric element (not shown) is provided. The piezoelectric element is deformed when a predetermined voltage pulse is applied. With the deformation of the piezoelectric element, ink filled in the nozzle 35 is pushed out from the nozzle 35 to be then ejected.

The recording head 34 is provided at a lower face of the carriage 32 to face the platen 17. The plurality of nozzles 35 of the recording head 34 are provided in a direction where ink is ejected to the platen 17. The plurality of nozzles 35 are arranged in parallel in the sheet transporting direction Y and a moving direction of the carriage, for example. A region between the plurality of nozzles 35 and the platen 17 forms a printing region PR where ink is attached to the paper P.

Figure 2:
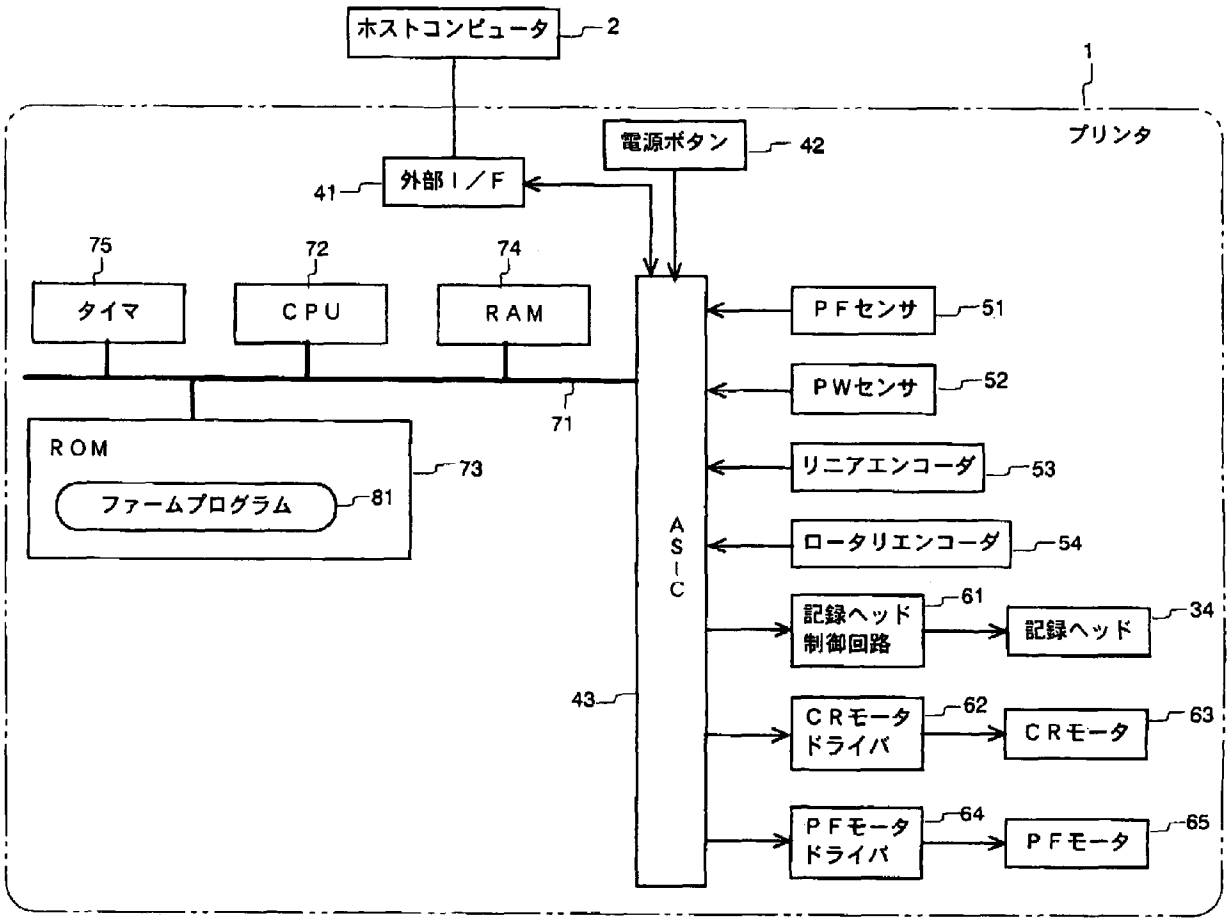
FIG. 2 is a block diagram showing a system configuration of the printer.
Figure 3:
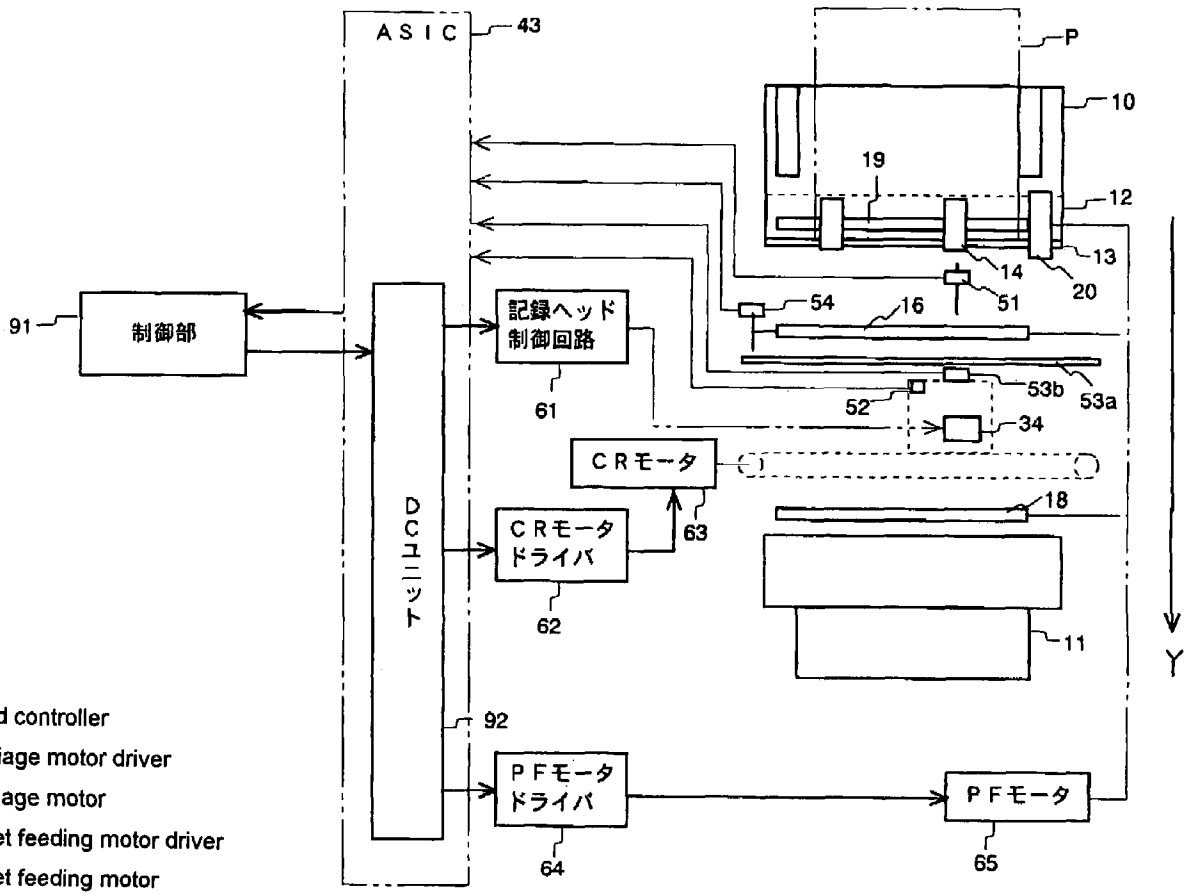
FIG. 3 is a block diagram showing a control configuration of the printer.

As shown in FIGS. 2 and 3, the control system of the printer 1 comprises the external interface 41, to which a host computer 2 is connected, and a power button 42.

The external interface 41 has a connector (not shown) to which a USB (Universal Serial Bus) cable, a cable for the printer 1, a SCSI (Small Computer System Interface) cable, or the like can be connected. The external interface 41 receives print data from the host computer 2 through the cable. Moreover, the external interface 41 may be connected to the host computer 2 through a wireless communication by Bluetooth, a wireless LAN (Local Area Network), or the like.

The power button 42 is, for example, a push button that connects/disconnects two terminals according to the operation of the button.

The external interface 41 and the power button 42 are connected to an ASIC (Application Specific Integrated Circuit) 43. The ASIC 43 is a computer that has a CPU (Central Processing Unit), a RAM (Random Access Memory), a programmable ROM (Read Only Memory), a timer, and the like (not shown), and that operates at a predetermined timing on the basis of a program stored in the programmable ROM.

Further, the ASIC 43 has an I/O (Input/Output) port, an ADC (Analog to Digital Converter), a DAC (Digital to Analog Converter), and the like (not shown).

The I/O port is used for input/output of a digital signal. The ADC samples a waveform of an input signal at a predetermined cycle. The DAC outputs a signal that changes to a level according to a set value at a predetermined sampling cycle.

To the I/O port of the ASIC 43, a sheet feeding sensor 51, a sheet edge sensor 52, a linear encoder 53, a rotary encoder 54 are connected in order to detect the status of the printer 1. Moreover, to the I/O port, a platen gap sensor, a CD-R (CD-Recordable) tray sensor, a CD-R guide sensor, and the like may be further connected.

As shown in FIG. 1, the sheet feeding sensor 51 has a transmissive optical sensor 51*a* and a retract lever 51*b*. The sheet feeding sensor 51 is used to detect a paper end, such as a leading end or a trailing end of the paper P passing through the sheet guide 15.

The retract lever 51*b* is a member that is formed of an opaque material and has a slender rod shape. The retract lever 51*b* is provided to pivot in the sheet transporting direction Y. Further, the transmissive optical sensor 51*a* has a light emitting element and a light receiving element (not shown) facing each other. As shown in FIG. 1, the transmissive optical sensor 51*a* of the sheet feeding sensor 51 is shielded by the retract lever 51*b* in a state where a lower end of the retract lever 51*b* comes into contact with the sheet guide 15, and thus light from the light emitting element is not incident on the light receiving element. For example, when the lower end of the retract lever 51*b* is pushed up by the paper P to be transported on the printing medium sheet transporting path, the retract lever 51*b* is slipped out of a space between the light emitting element and the light receiving element. Then, light from the light emitting element is incident on the light receiving element. The light receiving element changes according to the amount of received light in a digital manner, and outputs, to the I/O port of the ASIC 43, a light receiving signal that changes between "with sheet" and "no sheet".

Figure 4:
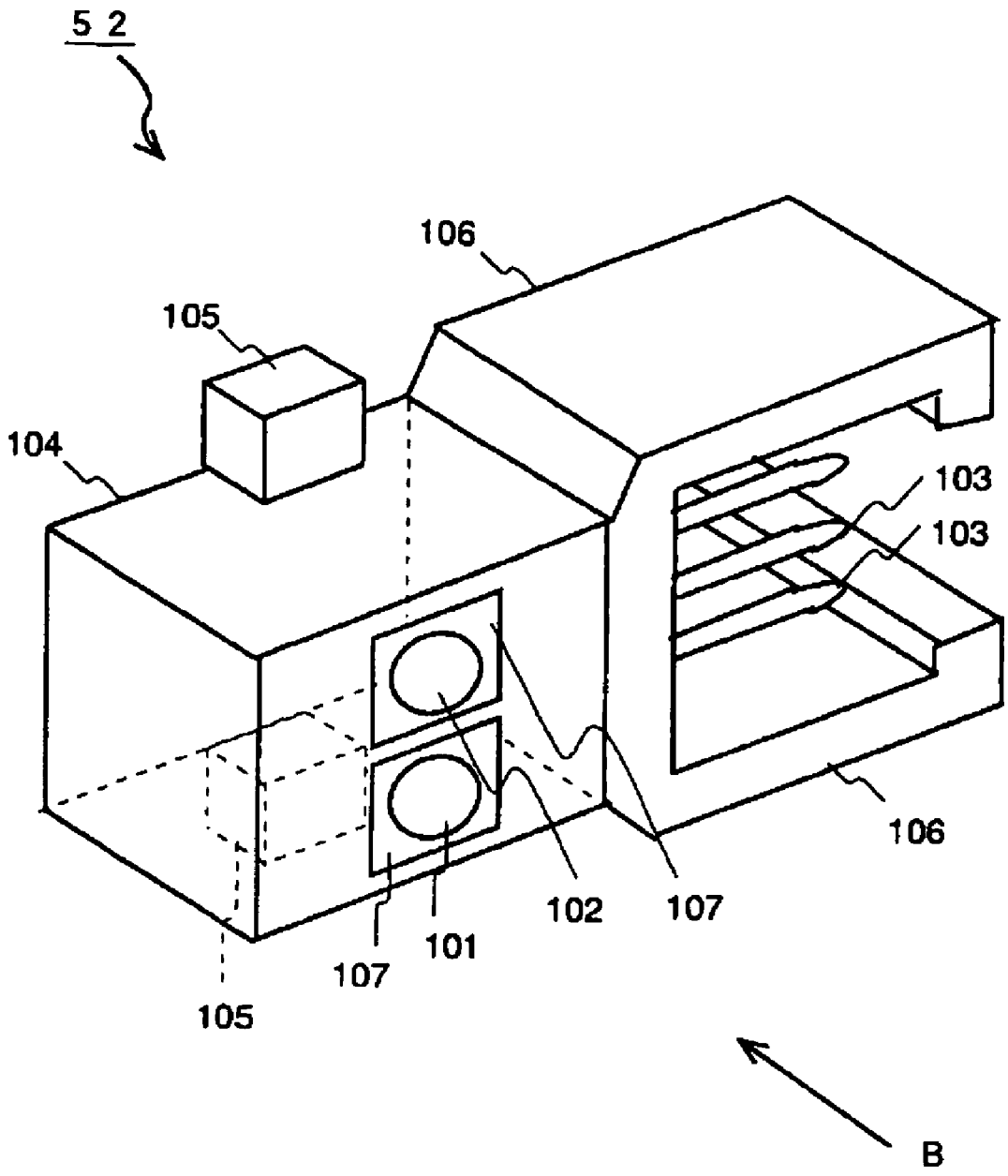
FIG. 4 is a perspective view of a sheet edge sensor in the printer.

As shown in FIG. 4, the sheet edge sensor 52 has a light emitting element 101, a light receiving element 102, and a plurality of connection terminals 103. The light receiving element 102 outputs, to the I/O port of the ASIC 43, a light receiving signal that changes according to the amount of received light.

A main body 104 is a molded body formed of a resin material, and has a pair of engagement portions 105, and a pair of leg portions 106. The main body 104, the pair of engagement portions 105, and the pair of leg portions 106 are monolithically formed.

The main body 104 has a substantially square, flat plate shape. At the front face of the main body 104, two recesses 107 are formed in parallel. The light emitting element 101 is provided in one of the two recesses 107, and the light receiving element 102 is provided in the other recess. The light emitting element 101 and the light receiving element 102 are provided in parallel with each other. Accordingly, light from the light receiving element 101 can be prevented from being directly incident on the light receiving element 102.

The pair of engagement portions 105 are provided to project in opposite directions from both sides of the main body 104. Each of the engagement portions 105 has a flat plate shape thinner and narrower than the main body 104. Further, as the main body 104 is viewed from the front face, that is, as the main body 104 is viewed in a direction of an arrow B, the pair of engagement portions 105 are provided at side faces of the main body 104 along the arrangement direction of the light emitting element 101 and the light receiving element 102 such that the light emitting element 101 and the light receiving element 102 are arranged in line between the pair of engagement portions 105. In addition, the pair of engagement portions 105 are provided along a rear face of the main body 104 such that rear faces of the engagement portions 105 are flush with the rear face of the main body 104.

The plurality of connection terminals 103 are terminals that electrically connect the light emitting element 101 and the light receiving element 102. The plurality of connection terminals 103 are provided in parallel along one side face of the main body 104. Further, the pair of leg portions 106 are provided to protrude in the same direction as the plurality of connection terminals 103 such that the plurality of connection terminals 103 are interposed therebetween. The plurality of connection terminals 103 and the pair of leg portions 106 form a connector.

As such, the light emitting element 101, the light receiving element 102, and the plurality of connection terminals 103 of the sheet edge sensor 52 are incorporated by molding using a resin material. Accordingly, for example, compared with a case where the light emitting element 101, the light receiving element 102, and the plurality of connection terminals 103 are soldered onto a substrate so as to form the sheet edge sensor 52, since damages due to heat or the like are little, lifetime of the sensor can be increased, and reliability of the sensor can be improved.

Figure 5:
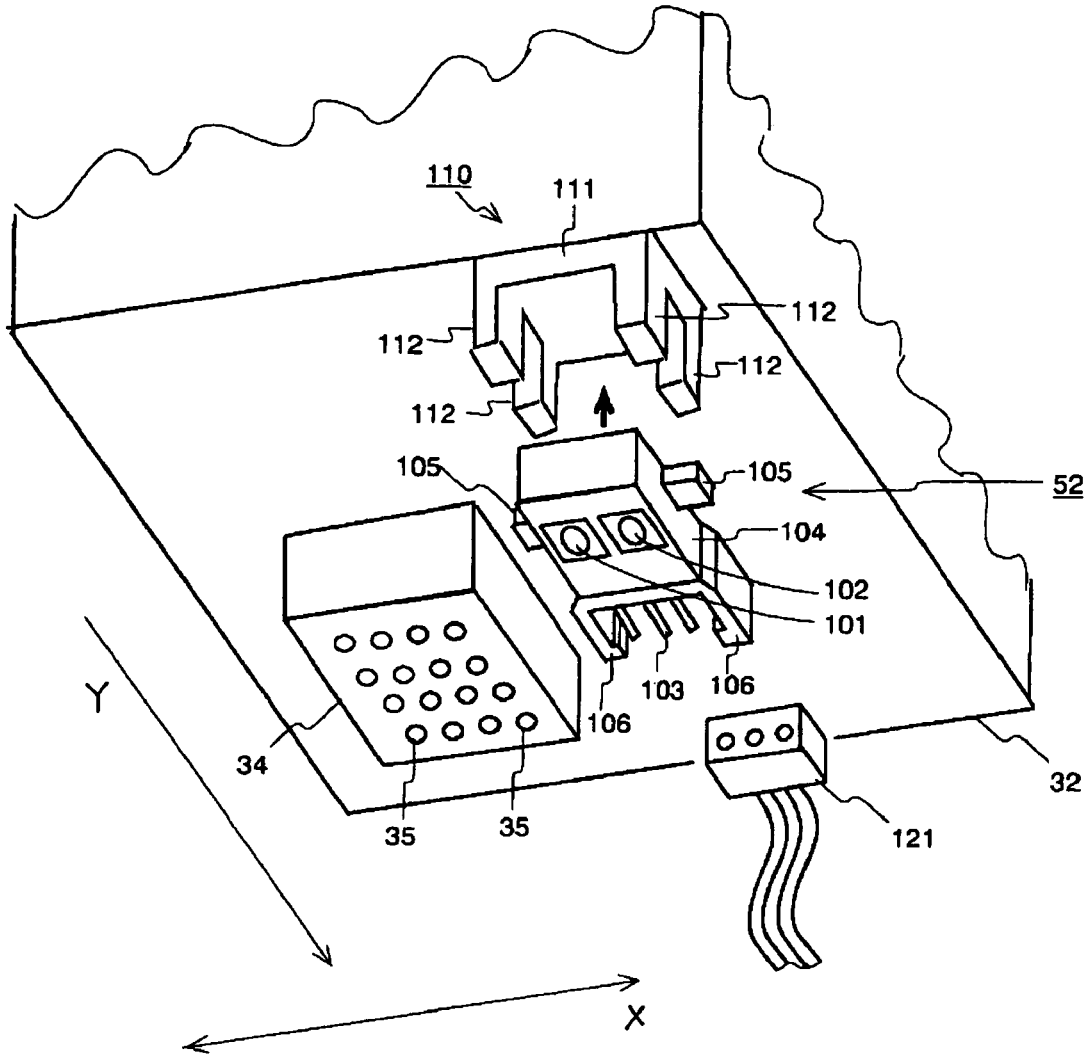
FIG. 5 is a perspective view of a carriage in the printer, viewed from a bottom side thereof.

As shown in FIG. 5, the paper P is transported from an upper left side of the paper toward a lower right side. The carriage 32 can substantially move in a lower left direction and an upper right direction.

The recording head 34 is provided at the central portion of the rear face of the carriage 32. A holder 110 that fixes the sheet edge sensor 52 to the carriage 32 is provided at a corner on an upper right side of the drawing in a state shown in FIG. 5.

The holder 110 has a retainer 111 formed with four projections 112.

The retainer 111 has a substantially rectangular, flat shape, and is fixed in the vicinity of an upper right corner of the carriage 32. One side face of the retainer 111 (a side face on the rear side in FIG. 5) is flush with a side face of the carriage 32 on an upstream side in the sheet transporting direction Y (on a side close to the sheet feeding roller 16).

Two of the four projections 112 are provided in the retainer 111 in parallel in the sheet transporting direction Y. The remaining two plates of the four projections 112 are provided in the retainer 111 in parallel in the sheet transporting direction Y. The two projections 112 of each set are provided to be spaced away from in the sheet transporting direction Y. Further, two sets of the projections 112 are spaced away from each other by a width of the main body 104 of the sheet edge sensor 52, and are provided in the retainer 111.

The sheet edge sensor 52 is fixed to the holder 110. The sheet edge sensor 52 is provided such that the pair of engagement portions 105 are respectively inserted between the two projections 112 of the individual sets, and the light emitting element 101 and the light receiving element 102 are downward. The pair of engagement portions 105 of the sheet edge sensor 52 are fixed by the two sets of the projections 112, and the main body 104 is fixed closely to the retainer 111 of the holder 110.

A connector 121 that is connected to the ASIC 43 described below is connected to the plurality of connection terminals 103 of the sheet edge sensor 52. The connector 121 that is inserted into the plurality of connection terminals 103 are clamped and held by the pair of leg portions 106. Since the connector 121 is clamped by the pair of leg portions 106, even though the carriage 32 moves at high speed and at rapid acceleration, the connector 121 is supported by the pair of leg portions 106 and are rarely separated from three connection terminals 103.

As such, the sheet edge sensor 52 is held by the holder 110 that is positioned in advance at the rear face of the carriage 32 and then fixedly disposed. Accordingly, a variation in position of the sheet edge sensor 52 is suppressed. Further, since the light emitting element 101 and the light receiving element 102 of the sheet edge sensor 52 are incorporated by resin molding, and relative positioning accuracy to the main body 104 or the pair of engagement portions 105 is enhanced.

Therefore, for example, compared with a case where the sheet edge sensor having the light emitting element 101 and the light receiving element 102 soldered onto a board is fixedly provided at the rear face of the carriage 32, positioning accuracy of the light emitting element 101 and the light receiving element 102 to the carriage 32 considerably increases.

As a result, relative positioning accuracy or gap precision to the recording head 34 that is provided in the same carriage 32 also increases, and a control based on a detection timing of a detection signal of the sheet edge sensor 52 can be more accurately executed.

The sheet edge sensor 52 is held by the holder 110 that is fixed to the carriage 32 in advance to be then fixed. The holder 110 is fixed to the carriage 32 so as to be flush with the side face of the carriage 32 on the upstream side of the sheet transporting direction Y before the sheet edge sensor 52 is mounted. As a result, the side face of the sheet edge sensor 52 on the upstream side of the sheet transporting direction Y is flush with the side face of the carriage 32 on the upstream side of the sheet transporting direction Y.

The sheet edge sensor 52 is held by the holder 110 such that the light emitting element 101 and the light receiving element 102 are arranged in parallel in a moving direction of the carriage 32 (primary scanning direction X). Positions where the light emitting element 101 and the light receiving element 102 are mounted are accurately positioned since the pair of engagement portions 105 are clamped by the projections 112 of the holder 110.

Therefore, as shown in FIG. 1, a detecting position DP where the light emitting element 101 irradiates light the paper P and the light receiving element 102 receives reflected light can be set to a position away from the printing region PR, even though the sheet edge sensor 52 is provided in the carriage 32. A large gap (A of FIG. 1) can be ensured between the detecting position DP and the printing region PR, compared with a case where the light emitting element 101 and the light receiving element 102 are arranged in the sheet transporting direction Y. As a result, the sheet edge sensor 52 can rapidly detect a leading edge or a trailing edge of the paper P, and a control for decreasing a sheet feeding speed can be executed on the basis of the trailing edge detection of the paper P by the sheet edge sensor 52.

The connector that has the plurality of connection terminals 103 and the pair of leg portions 106 is provided at a place of a side portion of the main body 104 where the pair of engagement portions 105 are not formed. Therefore, the connector can be provided along the carriage 32, like the main body 104, and a protrusion thickness of the sheet edge sensor 52 from the carriage 32 can be suppressed to the minimum. It is unnecessary to change design, for example, to widen a gap between the carriage 32 and the paper P in order to provide the sheet edge sensor 52.

As shown in FIG. 1, the linear encoder 53 has a slender reflection plate 53*a* and a reflective optical sensor 53*b* that has a light emitting element and a light receiving element arranged in parallel.

The slender reflection plate 53*a* has white patterns and black patterns that are alternately printed in a longitudinal direction thereof. The reflection plate 53*a* is provided close to the automatic sheet feeding unit 6 of the carriage 32 such that the longitudinal direction of the reflection plate 53*a* matches with the extending direction of the carriage shaft 31.

As shown in FIG. 1, the reflective optical sensor 53*b* of the linear encoder 53 is provided at the side face of the carriage 32 on the upstream side of the sheet transporting direction Y. The light emitting element emits light, and the light receiving element receives light reflected by the reflection plate 53*a*. The amount of light received by the light receiving element varies between a case where light is reflected by the white patterns of the reflection plate 53*a* and a case where light is reflected by the black patterns thereof. The light receiving element outputs, to the I/O port of the ASIC 43, a light receiving signal that changes according to the amount of received light in a digital manner.

The rotary encoder 54 has a disc plate 54*a* and a transmissive optical sensor 54*b* that has a light emitting element and a light receiving element arranged to face each other.

As shown in FIG. 1, in the disc plate 54*a*, a plurality of slits 54*c* are formed along its outer circumference. The disc plate 54*a* is incorporated into the sheet feeding roller 16. Accordingly, the disc plate 54*a* rotates together with the sheet feeding roller 16.

As shown in FIG. 1, the transmissive optical sensor 54*b* of the rotary encoder 54 is provided such that an outer peripheral portion of the disc plate 54*a* is interposed between the light emitting element and the light receiving element. When the slit 54*c* is located between the light emitting element and the light receiving element, light from the light emitting element is received by the light receiving element. When the disc plate 54*a* itself is located between the light emitting element and the light receiving element, light from the light emitting element is shielded. The light receiving element outputs, to the I/O port of the ASIC 43, a light receiving signal that change according to the amount of received light in a digital manner.

In addition, a head controller 61 is also connected to the I/O port of the ASIC 43. A plurality of piezoelectric elements provided in the plurality of nozzles 35 of the recording head 34 are connected to the head controller 61. The head controller 61 applies a voltage to the plurality of piezoelectric elements on the basis of ink ejection pattern data from the ASIC 43.

A carriage motor 63 is connected to the I/O port or the DAC of the ASIC 43 through a carriage motor driver 62. A sheet feeding motor 65 is connected to the I/O port or the DAC of the ASIC 43 through a sheet feeding motor driver 64.

The carriage motor driver 62 rotates the carriage motor 63 on the basis of a control signal from the ASIC 43. The carriage motor 63 is, for example, a DC motor. The rotary speed of the DC motor is accelerated or decelerated, for example, by controlling the magnitude of a current flowing therein. The carriage motor 63 rotates a rotary belt (not shown) to which the carriage 32 is fixed.

The sheet feeding motor driver 64 rotates on the basis of a control signal from the ASIC 43. The sheet feeding motor 65 is, for example, a DC motor, and is accelerated or decelerated, for example, by controlling the magnitude of a current flowing therein. A rotary driving force of the sheet feeding motor 65 is transported to the load roller 14, the sheet feeding roller 16, and the sheet ejecting roller 18. Moreover, the carriage motor 63 or the sheet feeding motor driver 64 may be a pulse motor, such as a stepping motor or the like.

A driving transport mechanism that transports the rotary driving force of the sheet feeding motor 65 to the load roller 14, the sheet feeding roller 16, and the sheet ejecting roller 18 transports the driving force, for example, such that a peripheral velocity of the rotating load roller 14, a peripheral velocity of the sheet feeding roller 16, and a peripheral velocity of the sheet ejecting roller 18 are substantially coincident with one another.

The driving transport mechanism transports the driving force to the load roller 14 such that the load roller 14 rotates one rotation at a time. Moreover, the driving transport mechanism may start one rotation operation, for example, by operating a lock lever (not shown) that locks the rotation of a gear for transporting the driving force to the load roller 14 by the carriage 32.

In addition, a system bus 71 is also connected to the ASIC 43. A CPU 72, a ROM 73, a RAM 74, and a timer 75 separated from the ASIC 43 are connected to the system bus 71. Moreover, the CPU 72, the ROM 73, the RAM 74, and the timer 75 may be formed as separate chips or a single chip.

The timer 75 measures a time. The timer 75 can set an elapsed time period, a time point, and the like. When the set time point comes, a timer interruption occurs in the CPU 72.

The ROM 73 stores a firm program 81 and the like. Moreover, the firm program 81 and the like stored in the ROM 73 may be stored in the ROM 73 before the shipment of the printer 1 or may be stored in the ROM 73 after the shipment of the printer 1. The firm program 81 and the like stored in the ROM 73 after the shipment of the printer 1 may be read from a computer-readable recording medium, such as CD-ROM or the like or downloaded through a transmission medium, such as a telecommunication circuit or the like. Further, a part of the firm program 81 and the like stored in the ROM 73 may be updated after the shipment of the printer 1.

The CPU 72 reads in the RAM 74 the firm program 81 stored in the ROM 73 and executes the firm program 81. Accordingly, as shown in FIG. 3, a controller 91 is implemented in the printer 1.

The controller 91 controls driving of the sheet feeding motor 65 and the carriage motor 63 through a DC unit 92 implemented in the ASIC 43 or the like. The controller 91 controls ink ejection from the plurality of nozzles 35 of the recording head 34 through the DC unit 92 and the head controller 61.

Moreover, the DC unit 92 has, for example, a DAC, an I/O port, and the like, and generates various signals that are output to the head controller 61, the carriage motor driver 62, and the sheet feeding motor driver 64. The DC unit 92 updates the output signals to the carriage motor driver 62 or the sheet feeding motor driver 64 for every predetermined time period (for example, tens microseconds).

Next, the operation of the printer 1 of this embodiment will be described.

When the power button 42 of the printer 1 is operated, the ASIC 43 activates the printer 1. Accordingly, as shown in FIG. 3, the DC unit 92 and the controller 91 are implemented in the printer 1.

The external interface 41 receives print data from the host computer 2 connected thereto, and the controller 91 of the printer 1 starts printing.

Moreover, for example, the host computer 2 generates an image to be printed on paper P, converts the generated image into images for the respective ink colors, performs a halftoning with respect to the images for ink colors, and rasterizes the halftoned images. The host computer 2 may transmit data after rasterizing to the printer 1 as print data.

In addition, the host computer 2 may transmit print conditions, such as data of images to be printed and the paper P or a layout, to the printer 1. In this case, in the printer 1, the ASIC 43 may generate the print data after rasterizing from the received image data and the print conditions.

When printing starts, the controller 91 first judges from the ASIC 43 whether or not the printer 1 is in a printable state on the basis of detection signals from the sheet feeding sensor 51, the sheet edge sensor 52, the linear encoder 53, and the rotary encoder 54.

When the printer 1 is in the printable state, the controller 91 starts a sheet feeding control that transports the paper P on the sheet feeding tray 10. The controller 91 starts a driving control of the sheet feeding motor 65. Next, the controller 91 monitors the detection signal of the sheet feeding sensor 51. Next, after the detection signal of the sheet feeding sensor 51 changes from a "no sheet" level to a "with sheet" level, the controller 91 adds the predetermined number of pulses to the number of cumulative pulses of the rotary encoder 54 at that change time, and determines, as a start timing of a deceleration control, a timing at which the number of cumulative pulses of the addition result reaches. After the start timing is determined, the controller 91 starts the deceleration control based on a predetermined table and stops the sheet feeding motor 65. Accordingly, the paper P on the sheet feeding tray 10 is transported to the printing region PR, and a leading end of the paper P is fed to the printing region PR facing the recording head 34.

After the leading end of the paper P is fed to the printing region PR by a sheet feeding control, the controller 91 executes the ink ejection control on the basis of the print data. The controller 91 and the DC unit 92 that operates on the basis of an instruction from the controller 91 starts driving of the sheet feeding motor 65, accelerates a moving speed of the carriage 32 to a predetermined speed, and executes a control for uniformly moving the carriage 32 at the predetermined speed. Moreover, the controller 91 and the DC unit 92 may recognize the moving speed of the carriage 32 on the basis of the number of pulses per unit time output by the linear encoder 53 on the basis of the patterns of the reflection plate 53*a*.

Subsequently, the controller 91 generates the ink ejection pattern data based on the print data, and supplies the generated ink ejection pattern data to the DC unit 92. The DC unit 92 monitors the sheet edge sensor 52, and starts the voltage application to the plurality of piezoelectric elements based on the ink ejection pattern data after the detection signal of the sheet edge sensor 52 changes from "no sheet" to "with sheet". Accordingly, ink starts to be ejected from the plurality of nozzles 35. The plurality of nozzles 35 eject ink on the basis of the ink ejection pattern data while uniformly moving through the carriage 32.

When the carriage 32 moves to the vicinity of the other end of the paper P, the detection signal of the sheet edge sensor 52 changes from "with sheet" to "no sheet". The DC unit 92 stops the voltage application to the plurality of piezoelectric elements based on the ink ejection pattern data according to the change. Moreover, a mask processing of inhibiting the voltage application to the plurality of piezoelectric elements may be executed by the head controller 61.

With the above-described ink ejection control, ink for a single scanning of the carriage 32 is attached at the leading end of the paper P fed to the printing region PR. At the leading end of the paper P, ink is partially attached with a width corresponding to a width in the sheet transporting direction Y of the plurality of nozzles 35.

When the ink ejection control for the single scanning is completed, the controller 91 executes a feeding pitch control. The controller 91 and the DC unit 92 that operates on the basis of the instruction from the controller 91 rotates the sheet feeding motor 65 by a predetermined amount through the sheet feeding motor driver 64. Accordingly, the paper P of the printing region PR is transported by a predetermined amount, and a next part of the paper P is located in the printing region PR. Moreover, the amount of sheet feeding pitch may be, for example, a width in the sheet transporting direction Y of the plurality of nozzles 35 or smaller.

When the initial feeding pitch control is completed, the controller 91 checks that the printer 1 is in the printable state, and then executes the ink ejection control of the second line. The controller 91 and the DC unit 92 controls the carriage 32 at a uniform speed, and then executes the ink ejection control based on the ink ejection pattern data for the second scanning line of the print data according to the paper edge detection of the sheet edge sensor 52. The DC unit 92 applies the voltage to the plurality of piezoelectric elements on the basis of the ink ejection pattern data until the sheet edge sensor 52 detects "no sheet".

Whenever the ink ejection control for single scanning is completed, the controller 91 checks whether or not unprinted print data remains. Then, when unprinted print data remains, the controller 91 starts a feeding pitch control. When the feeding pitch control is completed, the controller 91 generates next ink ejection pattern data based on unprinted print data and starts the ink ejection control for single scanning. Subsequently, the controller 91 alternately and repeatedly executes the two kinds of controls until no unprinted print data remains.

After no unprinted print data remains or before no unprinted print data remains, when the paper P is away from the retract lever 51*b*, and the detection signal of the sheet feeding sensor 51 changes from "with sheet" to "no sheet", the controller 91 starts a sheet ejecting control. The controller 91 rotates the sheet feeding motor 65 for a predetermined time period, and ejects the paper P fed to the printing region PR to the sheet ejecting tray 11 by the sheet ejecting roller 18. Accordingly, there is no case where ink is ejected from the recording head 34 in a state where the paper P does not exist in the printing region PR.

With the above-described controls, an image based on the print data is printed on the paper P ejected to the sheet ejecting tray 11. Further, the sheet edge sensor 52 detects the edge of the paper P, and the DC unit 92 controls ink ejection from the plurality of nozzles 35 of the recording head 34 such that ink ejection outside the paper P is suppressed to the minimum. Therefore, the printer 1 can print the image based on the print data on the paper P, including the edge of the paper P, which is so-called edgeless printing. Besides, the ejection outside the paper is suppressed, and thus ink not attached to the paper P can be effectively prevented from contaminating the inside of the printer 1.

Figure 6:
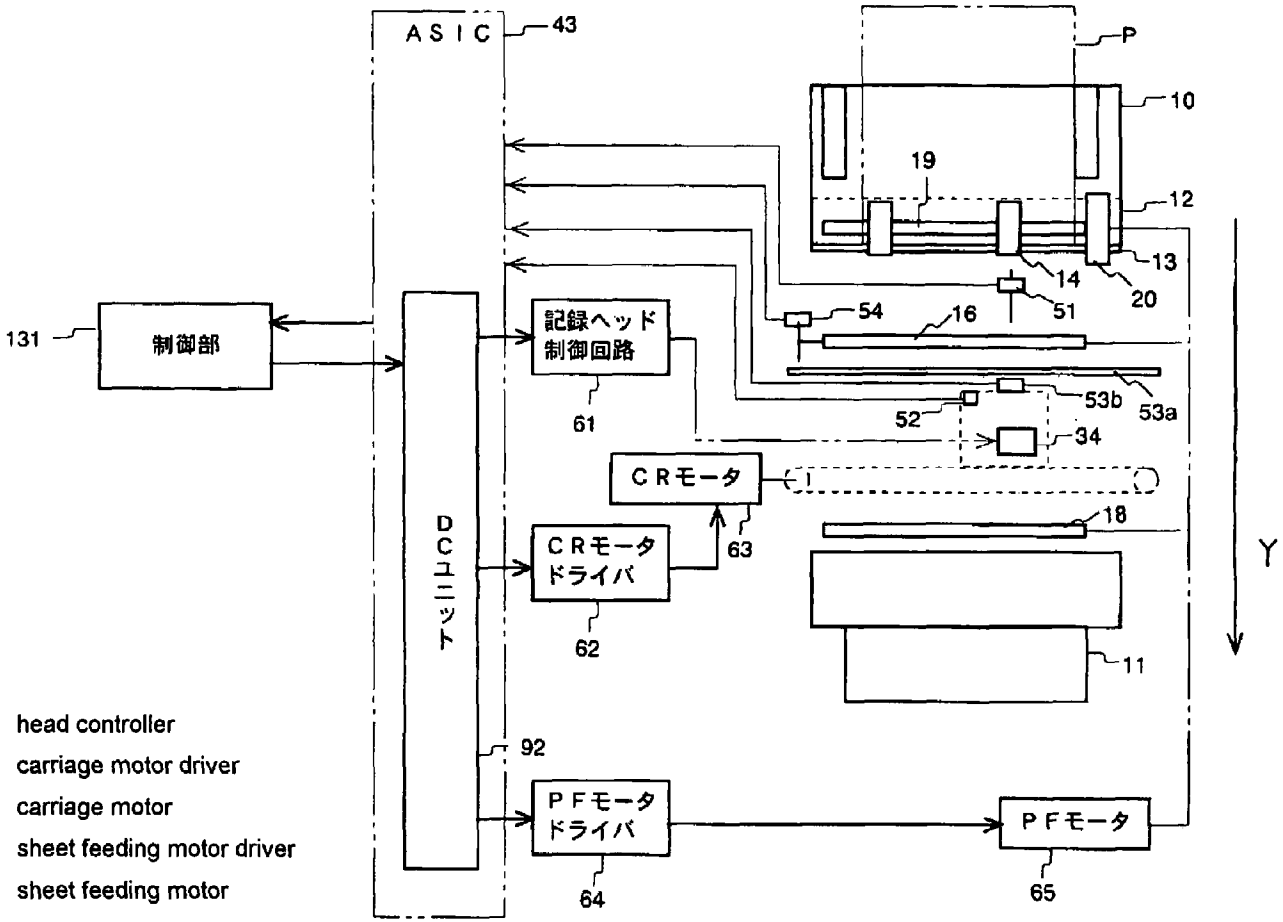
FIG. 6 is a block diagram showing a control configuration of a printer according to a second embodiment of the invention.

FIG. 6 shows a printer according to a second embodiment of the invention.

A controller 131 is implemented by causing a CPU 72 to execute a firm program stored in a ROM. The controller 131 controls driving the sheet feeding motor 65 and the carriage motor 63 through the DC unit 92 implemented in the ASIC 43 or the like. Upon a normal sheet feeding control, the controller 131 controls driving of the sheet feeding motor 65 by the amount of sheet feeding pitch of the length or less of a gap (A of FIG. 1) between the detecting position DP of the sheet edge sensor 52 and the printing region PR. The controller 131 controls ink ejection from the plurality of nozzles 35 of the recording head 34 through the DC unit 92 and the head controller 61.

In particular, the controller 131 of the second embodiment determines a start timing of the deceleration control during the sheet feeding control after the detection signal of the sheet edge sensor 52 changes from the "no sheet" level to the "with sheet" level. In addition, the controller 131 switches the ink ejection control and the sheet feeding control to the deceleration control when the detection signal of the sheet edge sensor 52 under the ink ejection control becomes "no sheet". When the detection signal of the sheet edge sensor 52 under the ink ejection control becomes "no sheet", the paper P does not exist at the detecting position DP of the paper P by the sheet edge sensor 52 that moves together with the carriage 32 moving for the ink ejection control. That is, after any sheet feeding control is performed, when the detection signal of the sheet edge sensor 52 under the ink ejection control becomes "no sheet", the trailing end of the paper P passes through the detecting position DP of the paper P by the sheet edge sensor 52.

Other parts than the above-described configuration have the same functions as those of the first embodiment. The same parts as those of the first embodiment are represented by the same reference numerals, and the descriptions thereof will be omitted.

Next, the operation of the printer 1 of this embodiment will be described.

The controller 131 sets the sheet edge sensor 52 on an upstream side of the printing region PR, and monitors the detection signal of the sheet edge sensor 52 after the driving control of the sheet feeding motor 65 starts so as to transport the paper P on the sheet feeding tray 10 to the printing region PR. Then, after the detection signal of the sheet edge sensor 52 changes from the "no sheet" level to the "with sheet" level, the controller 131 adds the predetermined number of pulses to the number of cumulative pulses of the rotary encoder 54 at that change time, and determines, as the start timing of the deceleration control, a timing at which the number of cumulative pulses of the addition result reaches. After the start timing is determined, the controller 131 starts the deceleration control based on a predetermined sheet feeding deceleration table and stops the sheet feeding motor 65. Accordingly, the paper P on the sheet feeding tray 10 is accurately transported to the printing region PR. The leading end of the paper P is fed to the printing region PR facing the recording head 34.

The ink ejection control and the feeding pitch control on the paper P fed to the printing region PR are repeatedly executed. Then, when the detection signal of the sheet edge sensor 52 during the previous ink ejection control keeps "no sheet", the controller 131 judges that the trailing end of the paper P is completely spaced away from the position of the sheet edge sensor 52 and starts a decelerated printing control. The decelerated printing control is a control for setting an ink ejection range by the amount of sheet feeding pitch of the carriage 32 smaller than a normal ink ejection range and specifically, setting the amount of sheet feeding pitch smaller than the amount of normal sheet feeding pitch. Moreover, the amount of sheet feeding pitch in the normal sheet feeding control is the gap (A of FIG. 1) between the detecting position DP of the sheet edge sensor 52 and the printing region PR or less. Therefore, when the detection signal of the sheet edge sensor 52 under the ink ejection control initially becomes "no sheet", that is, when the detection signal of the sheet edge sensor 52 becomes "no sheet" in the scanning direction of the carriage 32, the trailing end of the paper P is disposed between the detecting position DP of the paper P by the sheet edge sensor 52 and the printing region PR.

In the decelerated printing control, specifically, when it is checked that the detection signal of the sheet edge sensor 52 keeps "no sheet", the controller 131 generates ink ejection pattern data for ejecting ink with a width narrower than a width of the printing region PR where the plurality of nozzles 35 eject ink, and supplies the generated ink ejection pattern data to the DC unit 92. The controller 131 generates the ink ejection pattern data for ejecting ink from only a plurality of nozzles 35 on a downstream side of the sheet transporting direction, and supplies the generated ink ejection pattern data to the DC unit 92.

In the decelerated printing control, as for the ink ejection pattern data, the ink ejection width may be a width of half of the printing region PR. Accordingly, even though the ink ejection pattern data having the width of the printing region PR is generated in advance on the basis of the print data, the ink ejection pattern data of the width of the printing region PR is divided into two parts, and thus ink ejection pattern data having a width narrower than the width of the printing region PR can be easily generated.

After the carriage 32 enters the printing region PR at a predetermined speed, the DC unit 92 starts the voltage application to the plurality of piezoelectric elements based on the ink ejection pattern data. Accordingly, ink is ejected from a plurality of nozzles 35 on a downstream side of the sheet transporting direction. The plurality of nozzles 35 eject ink with an ink ejection width in the sheet transporting direction narrower than the normal while uniformly moving through the carriage 32. Moreover, when the carriage 32 moves the vicinity of the other end of the paper P, the DC unit 92 ends the voltage application to the plurality of piezoelectric elements.

When the ink ejection control with a width narrower than the normal is completed by the plurality of nozzles 35 on the downstream side of the sheet transporting direction, the controller 131 executes the decelerated sheet feeding control with the amount smaller than the normal. The controller 131 and the DC unit 92 that operates on the basis of the instruction from the controller 131 rotates the sheet feeding motor 65 by the predetermined small amount through the sheet feeding motor driver 64.

Whenever the decelerated ink ejection control for single scanning is completed, the controller 131 checks whether unprinted print data remains. Then, when unprinted print data remains, the controller 131 starts the decelerated sheet feeding control having the decreased amount of sheet feeding pitch. When the decelerated sheet feeding control is completed, the controller 131 generates next ink ejection pattern data based on the unprinted print data and starts the ink ejection control for single scanning by the plurality of nozzles 35 on the downstream side of the sheet transporting direction. Then, the controller 131 alternately and repeatedly executes the decelerated ink ejection control and the decelerated sheet feeding control until no unprinted print data remains.

After no unprinted print data remains or before no unprinted print data remains, when the decelerated ink ejection control and the decelerated sheet feeding control are executed predetermined times, the controller 131 starts the sheet ejecting control. The controller 131 rotates the sheet feeding motor 65 for a predetermined time period, and ejects the paper P fed to the printing region PR to the sheet ejecting tray 11 by the sheet ejecting roller 18.

Other operations than the above-described operation are the same as the printer 1 of the first embodiment, and thus the descriptions thereof will be omitted.

As described above, in the printer 1 of the second embodiment, the controller 131 executes the decelerated stop control during the sheet feeding control, the decelerated printing control of the trailing end of the paper P, and the sheet ejecting control on the basis of the presence/absence detection of the paper P by the sheet edge sensor 52. The controller 131 utilizes characteristics on the apparatus configuration in which the detecting position DP of the sheet edge sensor 52 is spaced away from the printing region PR, and executes the sheet feeding control having the decreased amount of sheet feeding pitch on the basis of the edge detection of the sheet edge sensor 52.

The sheet feeding sensor 51 is provided between the sheet feeding roller 16 and the load roller 14, and is spaced away from the printing region PR than the sheet edge sensor 52 does. Therefore, when the sheet feeding control having the decreased amount of sheet feeding pitch is executed on the basis of the presence/absence detection of the paper P of the sheet feeding sensor 51 as in the first embodiment, the length of a part of the paper P subjected to the decelerated sheet feeding control and the decelerated ink ejection control is enlarged. In such a case, a printing time required for printing one page increases. Accordingly, the number of printable pages per unit time reaches the limit.

In the second embodiment, the sheet feeding control having the decreased amount of sheet feeding pitch is controlled on the basis of the presence/absence detection of the paper P by the sheet edge sensor 52. Accordingly, the length of a part of the paper P subjected to the decelerated sheet feeding control and the decelerated ink ejection control is reduced. Therefore, the number of printable pages per unit time can be increased.

Figure 7:
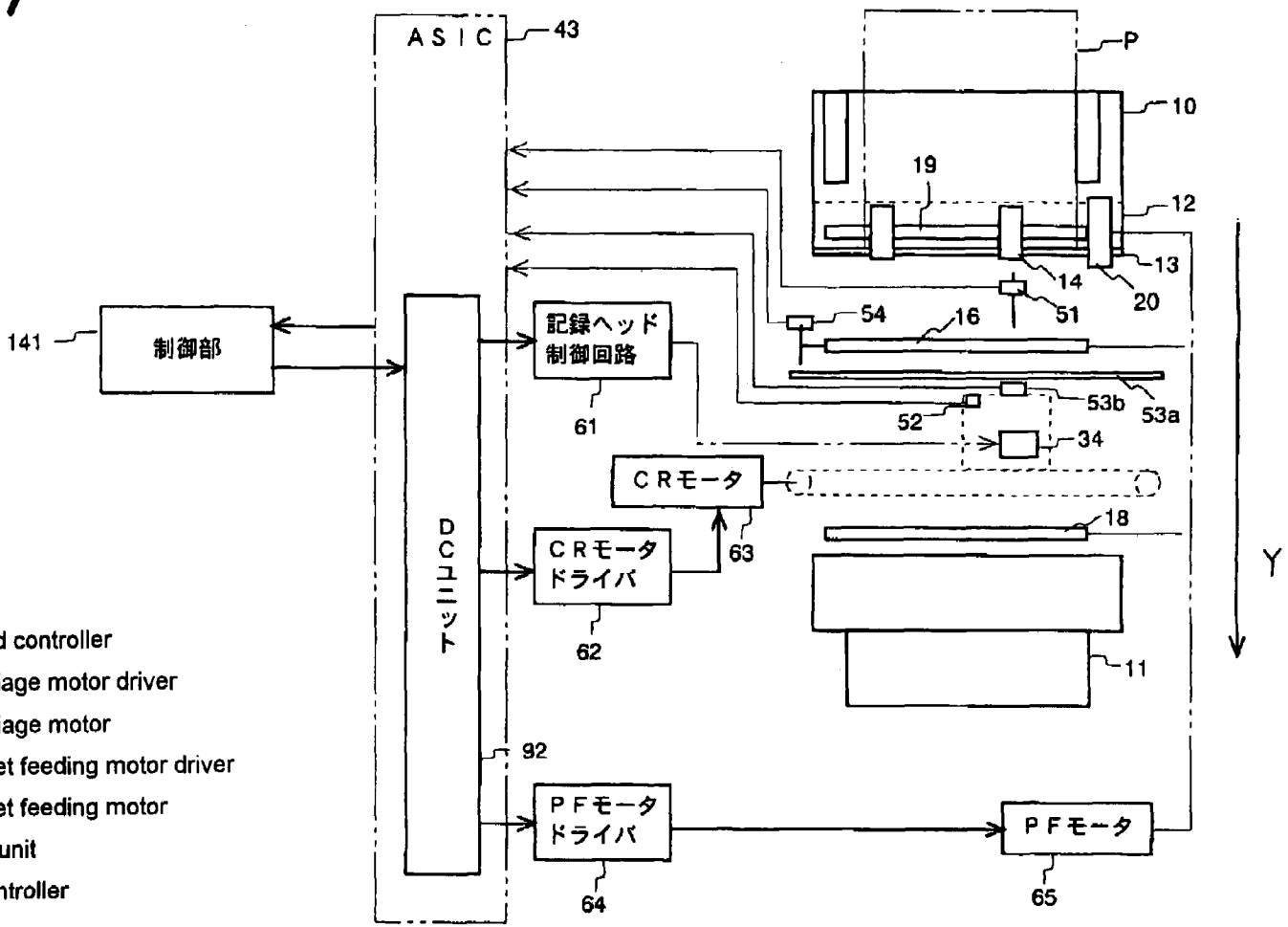
FIG. 7 is a block diagram showing a control configuration of a printer according to a third embodiment of the invention.

FIG. 7 shows a printer according to a third embodiment of the invention.

A controller 141 is implemented by causing the CPU 72 to execute the firm program stored in the ROM. The controller 141 controls driving of the sheet feeding motor 65 and the carriage motor 63 through the DC unit 92 implemented in the ASIC 43 or the like. The controller 141 controls driving of the sheet feeding motor 65 such that the amount of sheet feeding pitch by the normal sheet feeding control is the length or less of the gap (A of FIG. 1) between the detecting position DP of the sheet edge sensor 52 and the printing region PR. The controller 141 controls ink ejection from a plurality of nozzles 35 of the recording head 34 through the DC unit 92 and the head controller 61.

In particular, the controller 141 of the third embodiment performs mask control for a next ink ejection control when the detection signal of the sheet edge sensor 52 keeps "no sheet" in a period where the carriage 32 is driven for the ink ejection control. Further, when the mask control has been made, the controller 141 generates masked ink ejection pattern data such that ink is not ejected from some of the plurality of nozzles 35 (specifically, nozzles 35 on the upstream side of the sheet transporting direction) on the basis of the mask control.

Other parts than the above-described configuration have the same functions as those of the first embodiment. The same parts as those of the first embodiment are represented by the same reference numerals, and thus the descriptions thereof will be omitted.

Next, the operation of the printer 1 of this embodiment will be described.

The controller 141 sets the sheet edge sensor 52 so as to be located on the upstream side of the printing region PR, then starts the driving control of the sheet feeding motor 65 in order to transport the paper P on the sheet feeding tray 10 to the printing region PR, and subsequently monitors the detection signal of the sheet edge sensor 52. Next, after the detection signal of the sheet edge sensor 52 changes from the "no sheet" level to the "with sheet" level, the controller 141 adds the predetermined number of pulses to the number of cumulative pulses of the rotary encoder 54 at that change time, and determines, as the start timing of the deceleration control, a timing at which the number of cumulative pulses of the addition result reaches. After the start timing is determined, the controller 141 starts the deceleration control based on the predetermined table, and stops the sheet feeding motor 65. Accordingly, the paper P on the sheet feeding tray 10 is accurately transported to the printing region PR. That is, the leading end of the paper P is fed to the printing region PR facing the recording head 34.

The ink ejection control and the feeding pitch control are repeatedly executed on the paper P fed to the printing region PR. Then, when the detection signal of the sheet edge sensor 52 under the ink ejection control initially becomes "no sheet", the controller 141 sets "2" as a mask value.

The mask value may be stored in a memory (not shown) of the ASIC 43 or the RAM 74 by the controller 141. Further, the controller 141 resets the mask value as "0" upon a control for feeding new paper P to the printing region PR, and increments by "1" whenever the detection signal of the sheet edge sensor 52 under the ink ejection control becomes "no sheet".

Figure 8A:
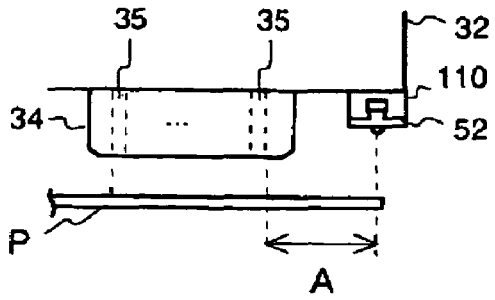
FIGS. 8A to 8C are schematic views for explaining a mask control performed by the printer of FIG. 7.
Figure 8B:
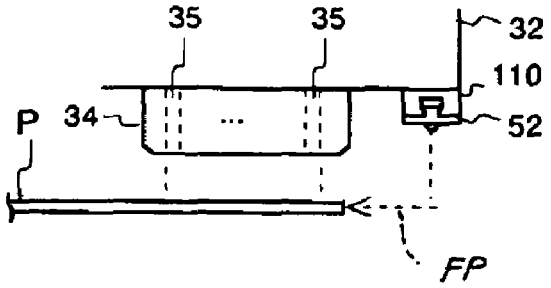
Figure 8C:
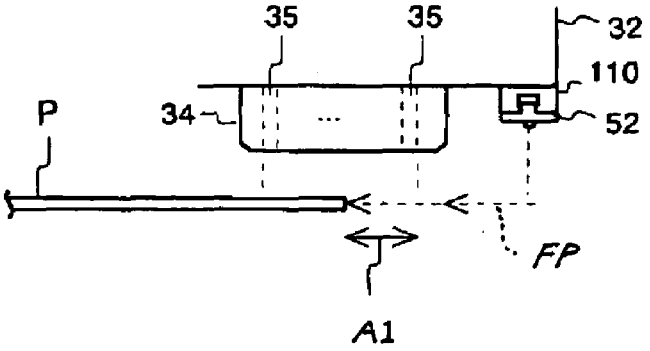

FIGS. 8A to 8C are explanatory views showing an example of a sheet feeding state upon printing of the trailing end of the paper P in the printer 1 of FIG. 7. FIG. 8A shows a state where the detection signal of the sheet edge sensor 52 under the ink ejection control changes from "no sheet" to "with sheet" in the scanning direction of the carriage 32. FIG. 8B shows a state where the detection signal of the sheet edge sensor 52 under the ink ejection control initially becomes "no sheet". FIG. 8C shows a state where the detection signal of the sheet edge sensor 52 under the ink ejection control becomes "no sheet" for the second time. In the state of FIG. 8B, the controller 141 sets the mask value "2".

As shown in FIGS. 8B and 8C, when the detection signal of the sheet edge sensor 52 under the ink ejection control becomes "no sheet", the trailing end of the paper P in the sheet transporting direction passes through the detecting position DP by the sheet edge sensor 52. Further, when a change is made from the state of FIG. 8A to the state of FIG. 8B, and when a change is made from the state of FIG. 8B to the state of FIG. 8C, the paper P is transported by a predetermined amount of sheet feeding pitch of the length or less of the gap A between the detecting position DP of the sheet edge sensor 52 and the printing region PR.

In the state of FIG. 8B, when the ink ejection control for single scanning is completed, the controller 141 checks whether unprinted print data remain. Then, when unprinted print data remains, the controller 141 starts a feeding pitch control.

When a change to the state of FIG. 8C is made by the feeding pitch control, the controller 141 generates next ink ejection pattern data based on unprinted print data. At this time, the controller 141 refers to the mask value stored in the memory (not shown) of the ASIC 43 or the RAM 74. Then, when a value of "2" or more is set as the mask value, the controller 141 generates ink ejection pattern data in which ink ejection of some or all of the plurality of nozzles 35 are limited. Specifically, the controller 141 inhibits the ink ejection from nozzles 35 within a range A1 having a length corresponding to the following equation (1). Here, the amount of sheet feeding pitch FP is the amount of normal sheet feeding pitch (no greater than A) and the mask value is designated as MV.

$$A1 = FP \cdot MV - A \quad (1)$$

When the ink ejection pattern data in which ink ejection from the nozzles 35 within the range A1 (here, the value of MV is 2) is limited is generated, the controller 141 starts the ink ejection control for single scanning. The controller 141 supplies the generated ink ejection pattern data to the DC unit 92. The DC unit 92 accelerates the carriage 32 at a predetermined speed, and executes the voltage application to the plurality of piezoelectric elements based on the ink ejection pattern data when the carriage 32 enters the printing region PR in the scanning direction. The plurality of nozzles 35 on the downstream side of the sheet transporting direction are not masked, and thus eject ink on the basis of the ink ejection pattern data. When the carriage 32 moves to the vicinity of the other end of the paper P, the DC unit 92 ends the voltage application to the plurality of piezoelectric elements based on the ink ejection pattern data and stops the carriage 32.

Whenever the ink ejection control for a single scanning is completed, the controller 141 checks whether unprinted print data remains. Then, when unprinted print data remains, the controller 141 starts the sheet feeding control with the amount of normal sheet feeding pitch. When the sheet feeding control is completed, the controller 141 generates next ink ejection pattern data in which the ink ejection is limited on the basis of the equation 1, and starts the ink ejection control. The controller 141 alternately and repeatedly executes the sheet feeding control with the amount of normal sheet feeding pitch and the ink ejection control, in which the ink ejection is limited, until no unprinted print data remains.

After no unprinted print data remains or before no unprinted print data remains, the controller 141 increments the mask value by "1" for each scanning of the carriage 32. As a result, when the mask value is a predetermined value or more, the controller 141 starts the sheet ejecting control. When the ink ejection limited range A1 calculated by the equation (1) is a width of the printing region PR in the sheet transporting direction or more, the controller 141 starts the sheet ejecting control. The controller 141 rotates the sheet feeding motor 65 for a predetermined time period, and ejects the paper P fed to the printing region PR to the sheet ejecting tray 11 by the sheet ejecting roller 18.

Other operations than the above-described operation of the printer 1 are the same as those in the first embodiment, and thus the descriptions thereof will be omitted.

As described above, in the printer 1 of the third embodiment, the controller 141 executes the decelerated stop control during the sheet feeding control, the printing control of the trailing end of the paper P, and the sheet ejecting control on the basis of the presence/absence detection of the paper P by the sheet edge sensor 52. The controller 141 utilizes characteristics on the apparatus configuration in which the detecting position DP of the sheet edge sensor 52 is spaced away from the printing region PR, and executes the control, in which the ink ejection is limited, on the basis of the paper detection of the sheet edge sensor 52, without decreasing the amount of sheet feeding pitch to the trailing end of the paper P.

Figure 9A:
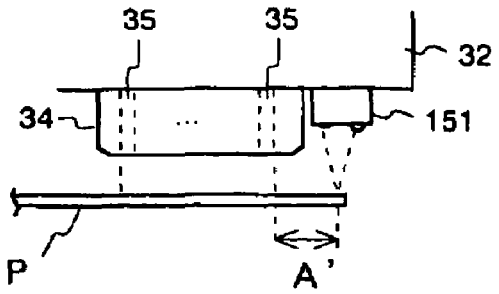
FIGS. 9A to 9C are schematic views for explaining a mask control performed by a printer according to a comparative example.
Figure 9B:
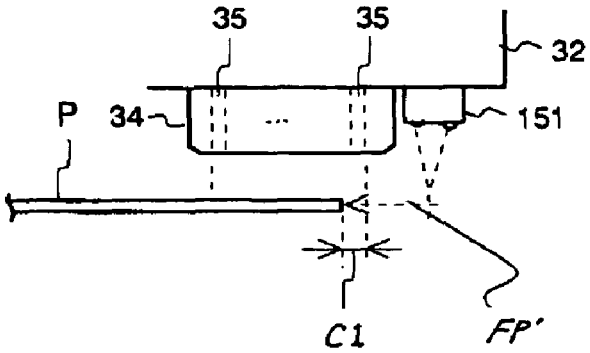
Figure 9C:
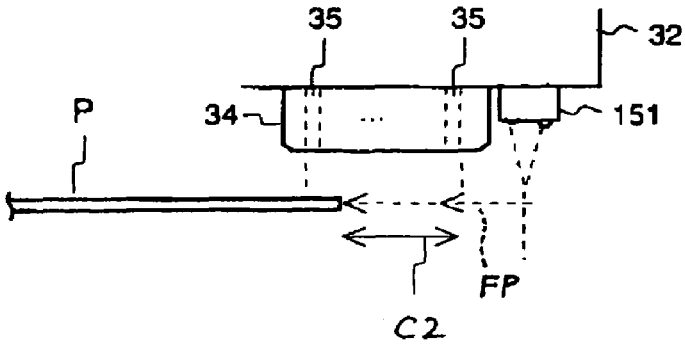

FIGS. 9A to 9C are explanatory views showing the printing control to the trailing end of the paper P by a printer according to a comparative example, instead of the printer shown in FIG. 7. The printer of the comparative example has a sheet edge sensor 151 that is provided close to the recording head 34 in the transport direction of the paper P. Further, the sheet edge sensor 151 of the comparative example has a light emitting element and a light receiving element arranged along the sheet transporting direction of the paper P. For this reason, in the printer of the comparative example, the length of a gap A' between the detecting position DP of the sheet edge sensor 151 and the printing region PR is shorter than the length of the gap A in the printer 1 of the third embodiment or the amount of sheet feeding pitch in the normal sheet feeding control.

FIG. 9A. shows a state where the detection signal of the sheet edge sensor 151 under the ink ejection control changes from "no sheet" to "with sheet". FIG. 9B shows a state where the detection signal of the sheet edge sensor 151 under the ink ejection control initially becomes "no sheet". FIG. 9C shows a state where the detection signal of the sheet edge sensor 151 under the ink ejection control becomes "no sheet" for the second time. In the state of FIG. 9B, the controller sets the mask value "2". In the state of FIG. 9C, the controller sets the mask value "3".

When the ink ejection control in the state of FIG. 9A is completed, the controller of the comparative example performs the control with the amount of normal sheet feeding pitch. For this reason, as shown in FIG. 9B, when the detection signal of the sheet edge sensor 151 under the ink ejection control initially becomes "no sheet", the trailing end of the paper P may enter the printing region PR.

In FIG. 9A, the sheet edge sensor 151 does not detect the trailing end of the paper P. For this reason, as shown in FIG. 9B, the controller of the comparative example executes the normal ink ejection control in a state where the trailing end of the paper P enters the printing region PR. The plurality of nozzles 35 eject ink between the read rend of the paper P in the printing region PR and the upstream side of the printing region PR in the sheet transporting direction. Ink ejected outside the paper P (the region designated by C1) is not attached to the paper P. Ink not attached to the paper P becomes mist floating inside the printer 1, and contaminates the inside of the printer 1 or the paper P. In case of the printer of the comparative example, a large amount of ink is used wastefully.

In the printer of the comparative example, in order to reduce the waste amount of ink in the state of FIG. 9B, it is necessary to make the amount of sheet feeding pitch of the paper P when a change is made from the state of FIG. 9A to the state of FIG. 9B the length or less of the gap A' between the detecting position DP of the sheet edge sensor 151 and the printing region PR. As such, when the amount of sheet feeding pitch is reduced, a printing time per one paper P increases, and printing throughput is degraded.

When a change to the state of FIG. 9C is made by the feeding pitch control, next ink ejection pattern data is generated based on unprinted print data. At this time, the mask value stored in the memory (not shown) of the ASIC 43 or the RAM 74 is referred. Then, when a value of "2" or more is set as the mask value, it is generated ink ejection pattern data in which ink ejection of some or all of the plurality of nozzles 35 are limited. Specifically, it is inhibited the ink ejection from nozzles 35 within a range C2 having a length corresponding to the following equation (2). Here, the amount of sheet feeding pitch FP' is the amount of normal sheet feeding pitch (no greater than A') and the mask value is designated as MV.

$$C2=FP'\cdot MV-A' \quad (2)$$

In the third embodiment, the ink ejection is limited by detecting the trailing end of the paper through the sheet edge sensor 52, and thus the controller 151 does not need to reduce the amount of sheet feeding pitch of the paper P at the trailing end of the paper P. Even in the case of marginless printing, a printing speed per one paper P can be kept high, like other kinds of printing (for example, printing with margins or the like). It is possible to make the maximum sheet transporting speed of the paper high while the gap A between the detecting position DP of the paper P by the sheet edge sensor 52 is kept to be ensured wider than the printer of the comparative example.

Like the third embodiment, when sheet feeding with the decreased amount of sheet feeding pitch is controlled on the basis of the presence/absence detection of the paper P of the sheet edge sensor 52, the length of the part of the paper P subjected to the decelerated sheet feeding control and the decelerated ink ejection control is reduced. Therefore, when the maximum sheet transporting speed of the paper is made high, and the number of printable pages per unit time can be increased.

The above-described embodiments are examples of the preferred embodiments of the invention, but the invention is not limited to the embodiments. Various modifications and changes can be made without departing from the subject matter of the invention.

For example, in the above-described embodiments, the paper is transported and printing is performed on the paper. Alternatively, as a printing medium, onto which ink is ejected, for example, various mediums, such as a transparent film sheet, a disk medium, for example, CDR or DVD, or a metal plate, for example, an aluminum plate or the like, may be used. The disk medium or the metal plate is not placed on the sheet feeding tray 10, but may be directly transported from an opening formed below the sheet feeding tray 10 to the printing region PR.

In the above-described embodiments, the printer 1 is an ink jet printer operable to eject ink onto a printing medium: Alternatively, the printer 1 may be a laser printer, a photograph printing machine, or a printing apparatus.

The disclosure of Japanese Patent Applications No. 2005-292138 filed Oct. 5, 2005 and No. 2006-133011 filed May 11, 2006 including specifications, drawings and claims are incorporated herein by reference in their entirety.

What is claimed is:

1. A printer, comprising:

a recording head, having a plurality of nozzles adapted to eject ink droplets toward a printing medium which is transported in a first direction;

a head supporting member, supporting the recording head;

a light emitter, operable to emit light; and a light receiver, adapted to receive light reflected from the printing medium, wherein:

the nozzles are arranged in the first direction to form a nozzle array;

the light emitter and the light receiver are disposed between a first one of the nozzles and an upstream end of the head supporting member relative to the first direction;

the first one of the nozzles is located in an upstream end of the nozzle array relative to the first direction; and the light emitter and the light receiver are provided on the head supporting member and arranged in a second direction perpendicular to the first direction.

2. The printer as set forth in claim 1, wherein:

the head supporting member is a carriage operable to carry the recording head, the light emitter and the light receiver in the second direction.

3. The printer as set forth in claim 2, further comprising:

a sensor body, formed with recesses respectively holding the light emitter and the light receiver.

4. The printer as set forth in claim 3, further comprising:

a connector section, formed in the sensor body and adapted to be connected with a mating connector which is electrically connected to a control section of the printer.

5. The printer as set forth in claim 1, wherein:

the sensor body has a first face facing the upstream side, and the carriage has a second face facing the upstream side; and the sensor body is attached on the carriage such that the first face is made flush with the second face.

6. The printer as set forth in claim 5, further comprising:

a retainer, provided on the carriage and retaining the sensor body.

7. The printer as set forth in claim 6, wherein:

a projection is extended from the sensor body in the second direction; and the retainer comprises a pair of projections arranged in the first direction and clamping the projection therebetween.

* * * * *